US005105155A

United States Patent [19]

Boaze, Sr.

[11] Patent Number: 5,105,155

[45] Date of Patent: Apr. 14, 1992

[54] APPARATUS FOR SETTING TIMING OF INTERNAL COMBUSTION ENGINES

[76] Inventor: Timothy F. B. Boaze, Sr., 176 Rollings Hills, Lumberton, Tex. 77656

[21] Appl. No.: 583,652

[22] Filed: Sep. 17, 1990

[51] Int. Cl.[5] ..... F02P 17/00

[52] U.S. Cl. ..... 324/391

[58] Field of Search ..... 324/391, 392; 73/116, 73/118.1

[56] References Cited

U.S. PATENT DOCUMENTS

| | | | |
|---|---|---|---|
| 1,772,829 | 8/1930 | Giampaoli . | |
| 1,786,034 | 12/1930 | Smith . | |
| 1,957,432 | 5/1934 | Barnes . | |
| 2,615,929 | 10/1952 | Rider | 324/391 |
| 3,444,851 | 5/1969 | Sieger . | |
| 3,505,864 | 4/1970 | Crawford | 324/391 |
| 3,693,148 | 9/1972 | Pittman | 324/391 |
| 3,906,917 | 9/1975 | Lorti | 324/391 |
| 4,177,781 | 12/1979 | Marchelletta et al. | 324/391 |
| 4,950,996 | 8/1990 | Funatsuki et al. | 324/391 |

*Primary Examiner*—Kenneth A. Wieder
*Assistant Examiner*—Maura K. Regan
*Attorney, Agent, or Firm*—Crutsinger & Booth

[57] ABSTRACT

Apparatus for setting the spark timing of an internal combustion engine comprising a pointer element removably attachable to rotor of a distributor with its cap removed and a scale element removably attachable to the exterior of the distributor housing in cooperative relationship with said pointer element to indicate the time of ignition spark impulse to an engine cylinder relative to the piston position in said cylinder.

12 Claims, 1 Drawing Sheet

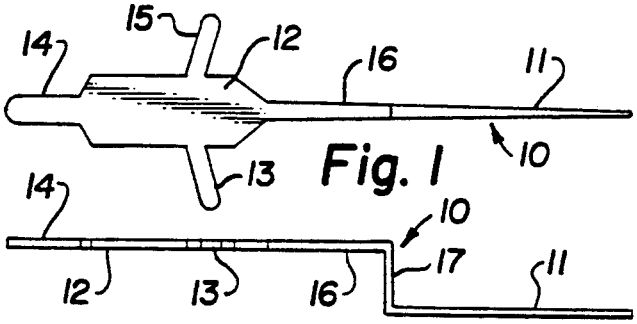
Fig. 1
Fig. 2
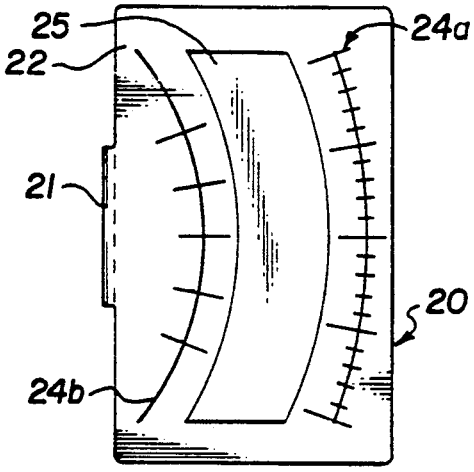
Fig. 3
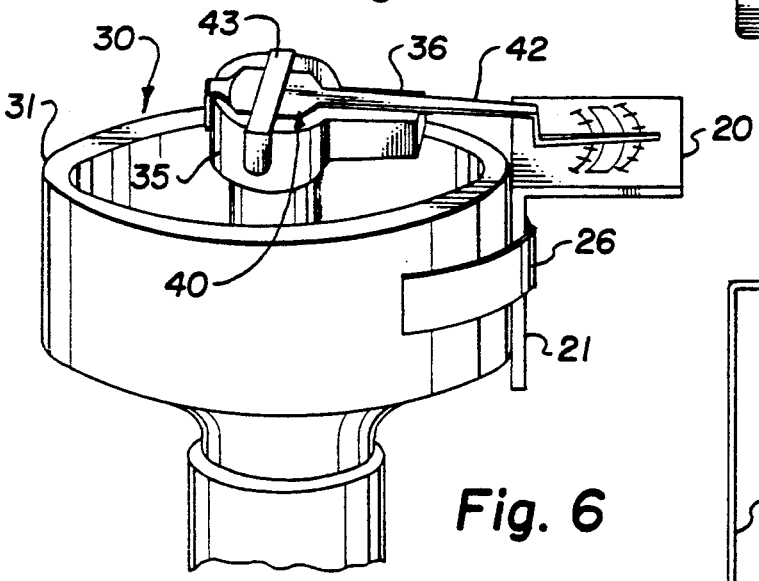
Fig. 6
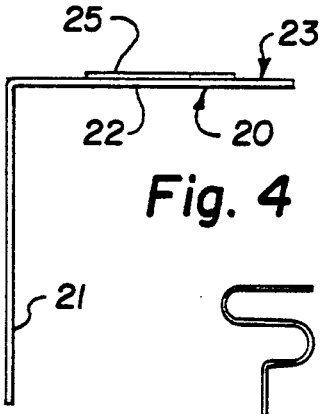
Fig. 4
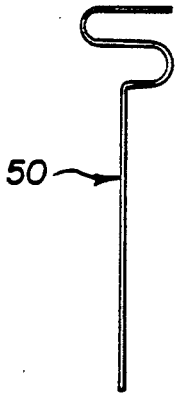
Fig. 7
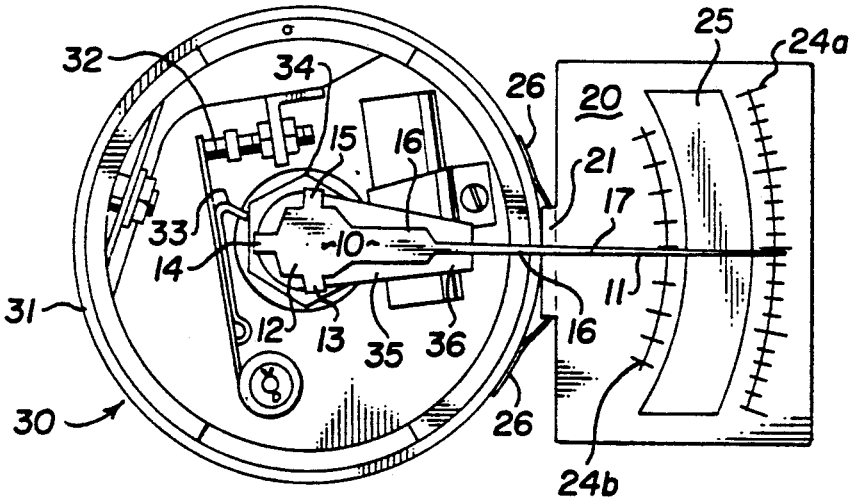
Fig. 5

APPARATUS FOR SETTING TIMING OF INTERNAL COMBUSTION ENGINES

BACKGROUND OF THE INVENTION

The present invention relates to an improved system for setting the ignition spark timing or "spark advance" on internal combustion engines using spark ignition.

By far the large majority of personal automobiles and small trucks in use today are powered by internal combustion gasoline engines wherein electrical discharge from a "spark plug" is used to ignite the compressed fuel-air mixture in each cylinder of the engine at a precise time during the engine cycle of operation.

Operation of internal combustion engines of the type referred to above is so well known that detailed description thereof is believed unnecessary. Suffice it to say that the ignition system of such an engine obviously includes a spark generator and distributor system having rotary components geared to the crankshaft of the engine. By such a system the electrical ignition pulses are generated and fed to the spark plug of each cylinder of the engine at an appropriate time to produce the series of sequential explosions in the cylinders needed to produce engine rotational operation.

In modern engines it is common practice to cause the ignition spark to be produced in each cylinder just slightly before the piston in that cylinder reaches its topmost or "top-dead center" position of its firing cycle. In addition, it is common practice to provide for an automatic spark advance, i.e., ignition slightly earlier in the cycle when it is required to produce increased power for acceleration, for example.

Setting or resetting the ignition timing for multi-cylinder gasoline engines in professional repair shops is often accomplished using sophisticated and expensive electronic computer equipment. However, such equipment is ordinarily unavailable to most of the vast number of amateur "handy man" types of automobile mechanics who out of preference or necessity perform repair work on their own or friends' car engines.

Even relatively inexpensive ignition timing equipment such as strobe light apparatus may be perceived as too costly for "do-it-yourselfers" who only occasionally have need of it. Further, such use of such timing apparatus requires that the engine be running. This may be a difficult condition to achieve for the amateur who has dismantled the engine beyond his ability to properly reassemble it for even marginal operation. Further, it has sometimes been found the timing indicator marks on the engine parts such as the front crankshaft hub or pulley are mis-positioned so that any strobe light timing setting would be inherently incorrect.

Thus, the present invention provides inexpensive easily operable apparatus useful to automobile engine mechanics and especially to do-it-yourself home mechanics for setting or resetting the electrical timing of an internal combustion engine while the engine is not running.

SUMMARY OF THE INVENTION

Briefly the apparatus of the present invention comprises two elements to be attached temporarily to the rotor and external housing respectively of the electrical ignition distributor of an internal combustion engine. The scale element of the present invention is adapted for attachment to the exterior of the distributor housing to provide a circumferential scale. The indicator element is adapted to be attached to the rotor and comprises an indicator having a pointer portion for alignment with the radius line from the rotor axis through the rotor electrical tip. The pointer portion extends past the distributor housing for a suitable distance and is used in conjunction with the scale element as an indicator of the angular position of the rotor.

To set the proper ignition timing without running the engine, the piston in a selected cylinder is set to top-dead center on its firing cycle. The distributor housing is then rotated to a point at which the ignition pulse fires. The indicator and scale elements are then temporarily attached to the distributor rotor and housing respectively to indicate a "zero" position on the scale. Thereafter the distributor housing is rotated in the "advance spark direction until the scale and indicator show that the manufacturer's tuner's recommended angular spark advance has been reached. At this position the engine is properly timed. The distributor housing is then clamped in this position.

It is therefore an object of the present invention to provide inexpensive apparatus for use in setting the electrical ignition timing of an internal combustion engine.

It is a further object of the present invention to provide apparatus easily operable by inexperienced engine mechanics to accurately set the electrical ignition timing of an internal combustion engine while the engine is in a non-running state.

It is still further object of the present invention to provide simple apparatus for setting the electrical ignition timing of an internal combustion engine while the engine is in a non-running state.

BRIEF DESCRIPTION OF THE DRAWINGS

These and other objects and advantages of the present invention will become apparent from the following detailed description when read with reference to the accompanying drawing wherein:

FIG. 1 is a top plan view of the preferred embodiment of the rotor indicator element of the present invention;

FIG. 2 is a side elevation view of the rotor indicator element of FIG. 1;

FIG. 3 is a top plan view of the preferred embodiment of the scale element of the present invention;

FIG. 4 is a side elevation view of the scale element of FIG. 3;

FIG. 5 is a top plan view of an automcbile distributor with the cap removed and the rotor indicator and scale elements of the present invention installed thereon for use;

FIG. 6 is a view in perspective of an automobile distributor with cap removed and the scale element and an alternative embodiment of the rotor indicator element installed on the distributor for use; and FIG. 7 is a top plan view of an alternate form of an indicator element of the present invention.

DETAILED DESCRIPTION OF THE INVENTION

With specific reference now to FIGS. 1 and 2 there are shown top plan and side elevation views of the preferred embodiment of the rotor indicator element 10 of the present invention.

The indicator element 10 comprises a pointer portion 11, a body portion 12 having mounting tabs 13, 14 and 15, an extension portion 16 and a vertical connecting portion 17. The indicator element 10 may be of any metal or alloy suitable for the purpose (such as for example certain steels) that may be suitably formed by stamping or similar processes and that is sufficiently ductile to allow repeated bending of the mounting tabs without their breaking. The thickness of the indicator may advantageously be between about 1/32 inch and about 3/64 inch.

Indicator 10 is to be of appropriate size for use with the distributor of the specific internal combustion engine on which the timing is to be set. Because the diameters of the distributor housings of essentially all automobile and small truck gasoline internal combustion engines.lie within a relatively narrow range of sizes a single size of indicator is ordinarily usable with almost any standard distributor provided the connecting portion 17 is spaced a distance from the body portion 12 to clear the housing wall of the largest distributor for which use of this device is intended.

The overall length of the indicator 10 may be between about about 3 to 4 inches preferably about 3½ inches. The body portion should be of a width and length to fit conveniently on the distributor rotor, 1½ inches long by about ⅝inch wide having been found acceptable. The extension/pointer portion may be about 3/16 inch wide near the body portion tapering to essentially a point at the tip of the pointer portion.

Turning now to FIGS. 3 and 4 there are shown top plan and side elevation views of the scale element 20 of the present invention. Scale element 20 comprises an attachment leg 21 extending from the essentially flat main body portion 22 at an angle of approximately 90° to the plane of the main body 22. The attachment leg may conveniently be about ½ to ¾ inch wide and of a length of about 2 or 3 inches. The material from which the scale element 20 is made is not critical. Thus, the scale element 20 may be formed of any suitable metal, plastic or other material of sufficient strength and rigidity to serve the purpose. The top surface 23 of element 20 is essentially planar and has marked, printed or engraved thereon one or more scales 24, scales 24*a* and 24*b* being shown in the present embodiment. Scales 24*a*, 24*b*, etc. are of a generally arcuate shape and drawn to essentially the same radius distance the reason for which will become apparent later in this discussion. Preferably one or more mirror-like reflective.elements 25 are attached to the top surface 23 of scale element 20. Element 25 may be a thin sheet or film of any suitable highly reflective metallic or plastic material. The reflective element 25 provides means to read accurately the scale indication of the pointer or needle positioned slightly above the scale in a manner well known in the art.

Use of the rotor indicating element 10 and scale element 20 of the present invention to set the electrical timing of an internal combustion engine is described with reference to FIG. 5. FIG. 5 is a top plan view of an engine distributor designated generally as 30 with its cap removed. Distributor 30 comprises a housing wall 31, breaker points 32 operated by cam follower 33 riding on the cam 34 which is attached to the rotor shaft of the distributor and coupled to and driven by the engine crankshaft. Rotor 35 is keyed to the rotor shaft and serves to deliver the spark pulse generated by each separation of the breaker points from the spark coil wire in the distributor cap to each spark plug in turn as the rotor turns. As will be recognized the foregoing description relates to conventional features and operation of an internal combustion engine distributor.

In making use of the present invention to set the timing of an engine the piston in a selected cylinder of the engine, for example, cylinder number one is brought to a top-dead center by rotation of the engine shaft by hand or other means. Top-dead center of number one cylinder piston can be set by aligning the timing marks provided for that purpose on the engine block and front shaft pulley or the harmonic balancer or flywheel of the engine if such marks are present and accurate. If such marks are not found or are believed for some reason to be inaccurate, the spark plug from a selected cylinder may be removed and a feeler element such as, for example, a screwdriver inserted through the spark plug opening to detect the piston top-dead center by "feel".

Thereafter distributor housing clamp or adjustment bolt is loosened and the distributor housing rotated about 15° in the direction retarding the spark timing, i.e., in the same rotational direction in which the rotor normally moves and then in the opposite direction until the breaker points separate. This separation may be detected by sparking of the removed spark plug when the engine ignition is "on," the ignition wire is attached to the spark plug cap and the plug body is grounded to the engine block. Alternately, an Ohm meter connected across the breaker points may be used to detect point separation when the distributor cap is removed and the engine ignition is off. At detection of point separation the distributor is held in that position (as by tightening the clamp bolt) while the indicator and scale elements 10 and 20 are temporarily installed on the open distributor. As shown in FIG. 5 the indicator element 10 is temporarily installed on the top of the distributor rotor 35 with the extension portion 16 of the pointer portion 11 extending in essentially the same direction as the arm 36 of rotor 35 by folding down tabs 13, 14 and 15 t hold the pointer in place. The scale element 20 is then temporarily attached to the housing 31 of the distributor at a height at which the top surface of the scale element is near but not quite touching the pointer portion of element 10. The scale is positioned so that the pointer portion of the indicator indicates zero degrees (i.e., is directly over the zero degree line) on the scales 24 of the scale element 20. The scale element may be held temporarily in position on the distributor housing by means such as a strip of adhesive tape 26 across the attachment leg 21 of the element.

With the pointer element 10 and scale element 20 in place as described the clamp bolt of the distributor housing is again loosened and the distributor housing turned in a direction advancing the spark (i.e., opposite the normal rotational direction of the rotor) until the pointer portion 11 of the indicator element 10 indicates on the appropriate scale of the scale element 20 the degree angle of spark advance recommended by the engine manufacturer for idle or start-up. Upon tightening of the clamp bolt of the distributor the electrical timing of the engine is correctly set.

While indicator element 10 has been disclosed as comprising stamped sheet metal or the like with the pointer portion offset from the plane of the body portion it should be recognized that such an offset is not necessary and the indicator element may be entirely flat and lying in a single plane. Further, indicator may be of wire of appropriate diameter such as about the diameter of.16 gauge wire and be of a curved shape resembling an "S" or appropriate "spread" to be held to the rotor with a tail to act as pointer as shown at 50 in FIG. 7.

The indicator and scale elements 10 and 20 may now be removed and the distributor reassembled and the spark plug reinserted to start the engine. At this point it should be noted that the positioning of indicator element 10 to be in exact alignment with the direction the rotor arm 36 extends is not critical. Because the scale element 20 when mounted to the distributor is positioned so that the pointer portion indicates zero degrees on the scale markings 24 the pointer will thereafter indicate on the appropriate scale 24 the correct amount of any rotational movement of the distributor housing.

As indicated in FIG. 6 the indicator element may take the form of a simple flat element 40 with a body portion 41 having a narrow extension 42 acting as the pointer portion. As may be seen in FIG. 6 indicator element 40 having no tabs may be mounted on the distributor rotor 35 by other convenient means such as, for example, an adhesive tape strip 43.

In designing the several scales 24 to be applied to the upper surface of scale element 20 it has been found convenient to have each scale encompass about a true 30° arc. The scale graduation markings indicate the amount of spark advance (+) or retardation (−) from zero (center scale). The markings are labeled in engine degrees of rotation which is only one-half the true arc distance on the scale since the engine rotates two revolutions (720°) for each complete firing cycle while the distributor rotor turns only one rotation (360°). Thus a true 10° rotation of the distributor amounts to a 20° rotation of the engine.

Also for convenience the various scales 24 are each designed to a single radius which may be for example, about three inches and the various scales are spaced appropriate distances across the scale element from the inner edge (nearest the distributor when mounted) to the outer edge. The spacing preferably positions each scale at essentially a three inch distance (or its chosen arc radius) from the rotor shaft axis when the scale element is attached to the distributor with which that particular scale is designed for use.

Although the present invention has been shown and described only in presently preferred embodiments it is to be recognized that many modifications and changes still within the scope and spirit of the invention are possible. Therefore, it is intended that this invention be limited only as set forth in the following claims:

What is claimed is:

1. Apparatus adapted for setting the spark timing of an internal combustion engine while said engine is not running comprising: a rotor indicating element and a scale element, said rotor indicating element comprising a relatively thin body portion of a size to be removably attached to the top surface of an engine distributor rotor and a relatively thin narrow pointer portion connected to said body portion and of a length to extend a distance past the external surface of the distributor housing when said indicator element is attached to the top surface of the rotor of said engine distributor with said pointer portion extending in the direction of the arm of said rotor, said scale element comprising a relatively narrow attachment leg extending downwardly at essentially a 90° angle from the main body portion, said main body portion having at least one indicator scale on the upper surface thereof said scale element being adapted for removable attachment to the external surface of the housing of said distributor by said attachment leg with said main body portion extending outwardly from said housing and in cooperative relationship with said indicator element when attached to said rotor to indicate an engine piston position at the instant electric spark pulse is delivered to the cylinder housing of said piston by said distributor.

2. Apparatus as defined in claim 1 wherein said at least one indicator scale comprises a plurality of indicator scales each at a different distance from the inner edge of said scale element.

3. The apparatus as defined in claim 2 wherein said scale indicators are arcuate and all have a common radius distance.

4. Apparatus as defined in claim 1 wherein the pointer tip of said indicator reaches at least to the scale indicator on said scale element designated for use with the particular distributor when said scale element and said indicator element are attached to said distributor housing and rotor respectively.

5. The apparatus as defined in claim 1 wherein said pointer portion of said indicator element is disposed in a plane different from but essentially parallel to the plane of said body portion and said pointer portion and said body portion are joined through a connecting portion.

6. An apparatus as defined in claim 1 wherein said indicator element body portion includes mounting tab members adapted to be bent into holding engagement with said distributor rotor.

7. Apparatus as defined in claim 1 wherein said scale element is adapted to be affixed to said distributor housing by adhesive tape disposed across said attachment leg.

8. Apparatus as defined in claim 1 wherein said indicator element comprises a wire-like element of suitable configuration providing an elongated pointer portion and a body portion attachable to said rotor.

9. Apparatus as defined in claim 1 wherein said indicator is attached to said rotor by adhesive tape.

10. Apparatus as defined in claim 7 wherein said indicator element is attached to said rotor by adhesive tape.

11. Apparatus as defined in claim 3 wherein the tip of said indicator reaches at least to the scale designated for use with the particular distributor when said scale element and said indicator element are attached as intended to said distributor housing and its rotor respectively.

12. Apparatus as defined in claim 1 wherein said cooperative relationship is with said indicator element extending past said distributor housing and the scale of said scale element is disposed proximate to but below said indicator element.

* * * * *

UNITED STATES PATENT AND TRADEMARK OFFICE

CERTIFICATE OF CORRECTION

PATENT NO. : 5,105,155

DATED : April 14, 1992

INVENTOR(S) : Timothy F. B. Boaze, Sr.

It is certified that error appears in the above-identified patent and that said Letters Patent is hereby corrected as shown below:

Column 4, line 38, after "15 t" and before "hold" change "t" to read -- to --;

Column 5, line 34, after "single" insert -- arc -- .

Signed and Sealed this

Fifteenth Day of June, 1993

*Attest:*

*Attesting Officer*

Michael K. Kirk

MICHAEL K. KIRK

*Acting Commissioner of Patents and Trademarks*